United States Patent [19]

Davis

[11] 4,076,100

[45] Feb. 28, 1978

[54] OIL IMPERVIOUS ACOUSTICAL BOARD

[75] Inventor: George G. Davis, Cos Cob, Conn.

[73] Assignee: Frigitemp, New York, N.Y.

[21] Appl. No.: 730,323

[22] Filed: Oct. 7, 1976

Related U.S. Application Data

[63] Continuation-in-part of Ser. No. 497,952, Aug. 16, 1974, Pat. No. 3,991,848.

[51] Int. Cl.[2] ..... E04B 1/99

[52] U.S. Cl. ..... 181/290; 181/292; 181/293

[58] Field of Search ..... 181/33 G, 290, 292, 181/293

[56] References Cited

U.S. PATENT DOCUMENTS

| | | | |
|---|---|---|---|
| 3,103,987 | 9/1963 | Gildard et al. | 181/33 G |
| 3,202,561 | 8/1965 | Swanson et al. | 181/33 G |
| 3,433,322 | 3/1969 | Olsson | 181/33 G |
| 3,726,359 | 4/1973 | Dierl et al. | 181/33 G |
| 3,770,560 | 11/1973 | Elder et al. | 181/33 G |
| 3,963,094 | 6/1976 | Nowikas | 181/33 G |
| 3,967,693 | 7/1976 | Okawa | 181/33 G |
| 3,991,848 | 11/1976 | Davis | 181/33 G |

*Primary Examiner*—Brooks H. Hunt
*Attorney, Agent, or Firm*—Herbert C. Schulze

[57] ABSTRACT

This invention is a new and unique acoustical board formed of fire retardant materials which board has the unique qualities of being fire retardant, sound absorbing, heat insulating, and decorative, and may be formed virtually in any desired size and shape. It is composed of fiberglass reinforced melamine resin panels or the like having one grooved surface covered by fiberglass cloth with perforations suitable to admit sound waves into the grooved areas of the underlying board in such manner as to trap, and debilitate such sound waves therein, and, it has been particularly formed so as to be oil impervious, while retaining the sound deadening qualities by the insertion of a thin membrane of oil impervious material between the fiberglass cloth and the melamine panel.

2 Claims, 5 Drawing Figures

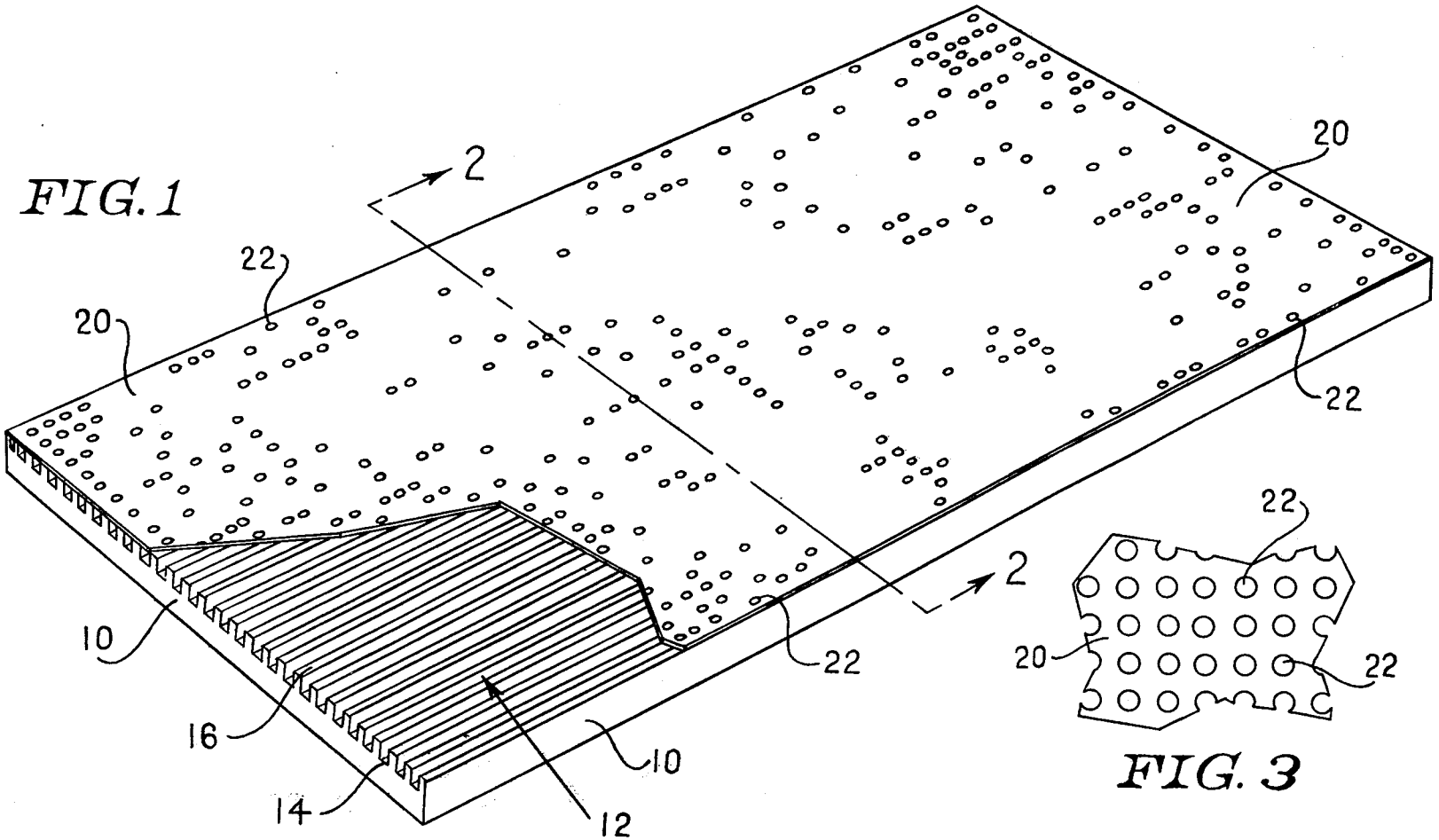
FIG. 1
FIG. 3
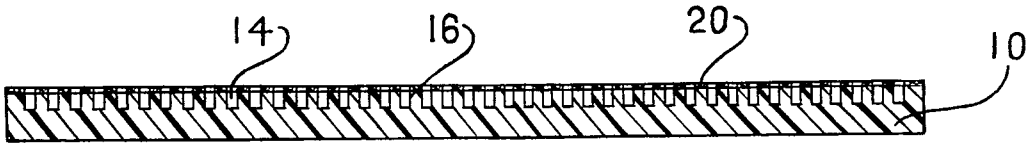
FIG. 2

OIL IMPERVIOUS ACOUSTICAL BOARD

CROSS REFERENCE TO RELATED PATENT APPLICATIONS

This application is related to, and is a continuation in part of my co-pending patent application entitled ACOUSTICAL BOARD filed Aug. 16, 1974 and bearing Ser. No. 497,952, now U.S. Pat. No. 3,991,848.

BACKGROUND OF THE INVENTION

1. FIELD OF THE INVENTION

This invention is in the general field of sound deadening materials used in building or other areas and is more particularly in the field of a sound deadening material which is also fire resistant and of low thermal conductivity. This invention is even more limited in being directed to a sound deadening material which has the further quality that is impervious to and unaffected by oil fumes within ships and the like.

2. DESCRIPTION OF THE PRIOR ART

There are great quantities of acoustical materials of various configuration and composition used in buildings and other confined areas. Such materials may be of loosely woven fibre, perforated elements, specially shaped elements, and the like. Each of such materials have certain characteristics; such as obsorption, transfer, passage, reflection, or the like, of sound waves coming in contact with the material.

Most of the materials used for this purpose are unsuited to many applications for a wide variety of reasons. In some instances the material is unsuited to conditions of cleanliness which may be desired (due to dusting and the like) or because of the necessity of complete protection against fire or moisture, or for a variety of other reasons. In certain circumstances, such as in the engine rooms of ships, and the like, there are oil fumes in the air, which frequently impregnate and contaminate the various sound deadening materials.

The present invention is a material which entraps sound waves and is non-dusting, is fire retardant, and is generally unaffected by chemicals. It is capable of economical formation in large segments and segments of irregular shapes. It is capable of formation, assembly, and repair in an economical manner in the field. By the ue of a special membrane, this invention is further distinguished from the prior art.

SUMMARY OF THE INVENTION

Increasing attention is being paid to the problems of the sound environment of rooms, ships, containers, vehicles, and the like.

There are many special requirements for the environment of certain activities, and the like. In some instances prime consideration must be given to acoustic quality perfection; In other cases prime consideration may be to sanitation with secondary consideration to acoustical qualities; In other situations protection against corrosion and the like is a prime consideration; In still other conditions thermal isolation is of prime interest; Under some circumstances fireproofing is of prime interest. Under all circumstances, the highest condition of acoustical characteristic is desired, consistent with the other requirements.

In attempting to achieve acoustical characteristic perfection, numerous acoustical materials have been developed including specially shaped materials, porous materials, and other materials known to those skilled in the art.

An interesting problem which occurs in marine installations, is that the engine rooms and certain other areas of ships may frequently have an atmosphere in which there are considerable oil funes. The oil fumes have a tendence to penetrate and impregnate the various materials used for acoustical purposes.

One thing which has been most difficult is to find a material which combines desired results in such manner that: It does not support combustion; It does not entrap moisture; It is unaffected by moisture; It is unaffected by chemical activity; It is non-toxic; It is non-dusting; It is of pleasing appearance; And, it effectively imparts desired acoustical characteristics to its environment. The further requirement to seal out oil and the like, and at the same time to have effective acoustical qualities, created a separate problem, which has now been very effectively solved as will be described.

Of less importance, but still of consequence, is the desire to be able to form materials as required to accomodate unusual shapes and conditions and to achieve field fabrication. Also, it is most desirable to be able to repair damage, stains, and the like without major rehabilitation or replacement.

I have devoted considerable attention to this problem of providing a suitable acoustical material to attempt to achieve all of the normally desired acoustical arresting qualities, and at the same time to overcome the numerous limitations of other materials and accomplish all of the ends as herein previously outlined.

I have conceived a new unique material in a particular form, which accomplished the hitherto unobtainable goals of (1) providing an acoustical material which will entrap sound waves within it; And (2) at the same time having qualities of being nonporous, non-dusting, unaffected by normal moisture and chemical conditions, easily formed in nearly any configuration, if fire retardant, attractive, and repairable if damaged without complete replacement.

I have accomplished all of this by a specially constructed melamine material, reinforced with glass fibers, and provided with a multiplicity of grooves of a particular configuration, which is entirely covered on the grooved side (the side exposed to sound waves) with a fiberglass cloth having particularly disposed perforations therein which cooperate with the grooves so as to allow the entry of sound waves through the performations and to allow the travel through the grooves with entrapment therein during which entrapment the energy of the sound waves is dissipated.

For those circumstances where it is desired to seal the acoustical material against the penetration by oil laden fumes or the like, a special membrane is inserted between the fiberglass cloth and grooved panel. Remarkably, it has been possible to provide such a situation where the sound waves will enter into the small perforations in the fiberglass and transmit itself through the underlining membrane into the grooves within the panel for dissipation and absorption, but at the same time, the membrane prevents the passage of oil or oil fumes into the basic panel material.

It is an object of this invention to provide an acoustical board having the characteristics of above mentioned;

Another object of this invention is to provide such an acoustical board which can be made assembled and installed easily in the location in which it is to be used;

Another object of this invention is to provide such an acoustical board wherein the sound waves are entrapped and dissipated;

Another object of this invention is to provide such an acoustical board as has been herein described, wherein the board is so formed of a special laminated material as to be impervious to oil fumes and the like which may exist in the atmosphere.

The foregoing and other objects and advantages of this invention will become apparent to those skilled in the art upon reading the description of the preferred embodiment which follows, in conjunction with a review of the appended drawings.

BRIEF DESCRIPTION OF THE DRAWINGS

FIG. 1 is a perspective of a preferred embodiment of an acoustical board of this invention, with certain portions broken away;

FIG. 2 is a section on 2—2 of FIG. 1;

FIG. 3 is an enlarged, plan view of a segment of the covering of the material;

DESCRIPTION OF A PREFERRED EMBODIMENT

Figure 4:
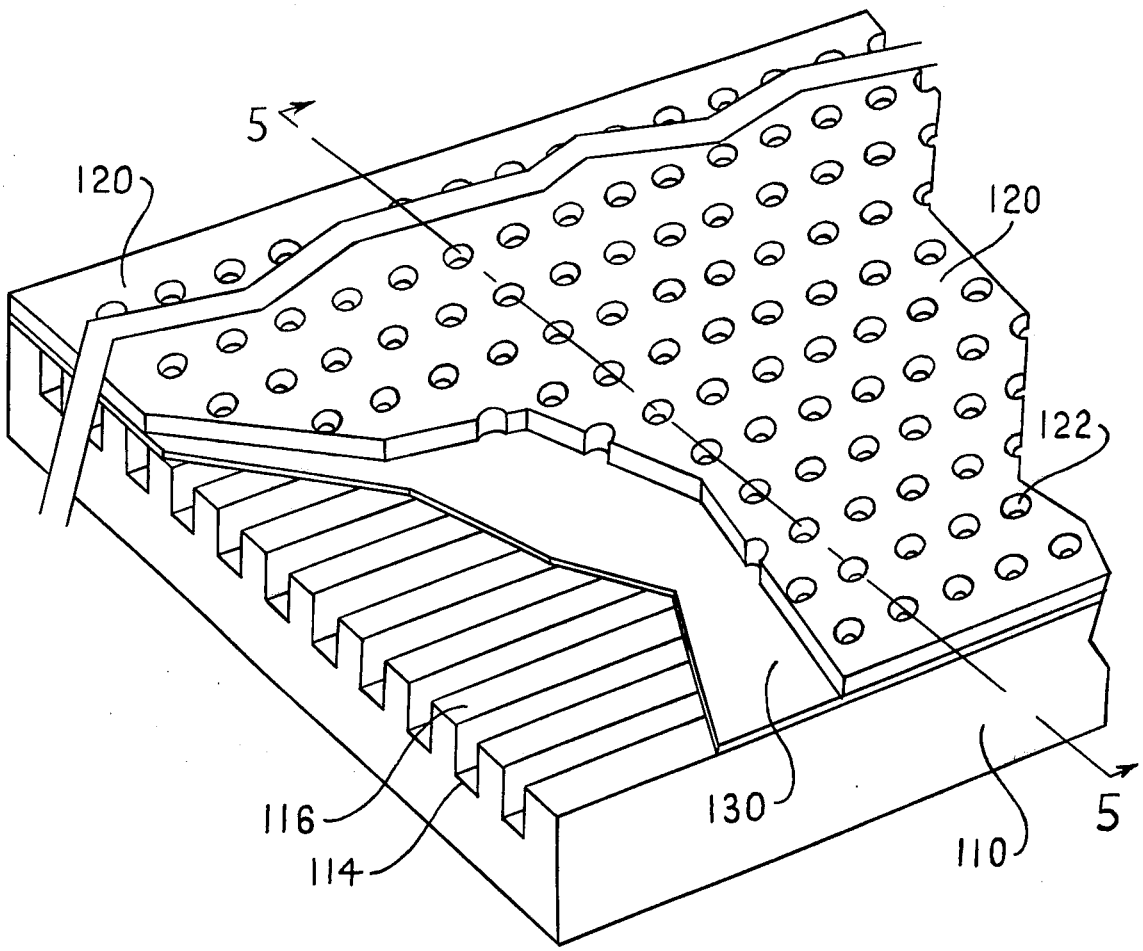
FIG. 4 is a perspective of an alternate embodiment of an acoustical board of this invention, especially designed to protect the board against oil fumes, with certain portions broken away.

Attention to FIG. 1 will result in the understanding that this invention comprises a baord of melamine, or its equal, 10, which may be of any desired configuration. For simplicity of illustration, and because this configuration constitutes the bulk of the material used, a rectangular piece has been shown. It is to be udnerstood that the piece could be circular, triangular, or any irregular shape. The shape and size will be dictated by the area being covered with the material.

It is to be observed that the surface of the melamine 12 is grooved as indicated, with grooves 14 having upstanding ridges 16 between them, as indicated.

The grooved area is covered by a sheet of fiberglass cloth or the equivalent 20, which has numerous perforations 22 on its surface. Only representative perforations have been shown, but in practice, the perforations will be uniform over the entire surface of the covering 20, and such perforations will be of the size and configuration such as to allow the passage of sound waves into the grooved area for dispersion and dissipation.

The representative configuration of the holes in the covering 20 is clear by an eximatination of FIG. 3 in which it is shown that they are aligned in such manner that they will be in alignment with the grooves.

FIG. 2 illustrates no additional elements, but it will be clear from FIG. 2 that the melamine board 10 having upstanding ridges 16, with grooves, 14, is covered by the fiberglass cloth 20 in such manner that the holes are in alighment for admitting the sound waves for dispersion within the grooves.

There are critical dimensions within limitations, as follows: The melamine board, which may be pure melamine or may consist of glass fibers impregnated with the melamine binder, will normally have a thickness of 1 or 2 inches as may be required by the particular application.

The grooves, preferably, will be 3/16 inch to ⅜ inch in depth, 3/16 inch in width, and spaced upon ½ inch centers from one another.

The fiberglass cloth, preferably, may be impregnated with some resin or other material to impart stiffness, and preferably, will be perforated with 3/16 inch diameter holes, spaced ½ inch from each other in all directions measured from center. Thus, it will seem, that the holes will be aligned above the grooves and will approcimately encompass the width of the grooves.

When formed in these dimensions, this material has a sound absorption co-efficient as indicated in the following table. In each case, the sound absorption co-efficient will be found to be equal to, or greater than that shown.

| Board Thickness Inches | Frequency, cycles per second. | | | | | |
|---|---|---|---|---|---|---|
| | 125 | 250 | 500 | 1000 | 2000 | 4000 |
| 1 | 0.06 | 0.25 | 0.70 | 0.90 | 0.75 | 0.70 |
| 2 | 0.22 | .70 | .90 | .85 | .75 | .75 |

Figure 5:
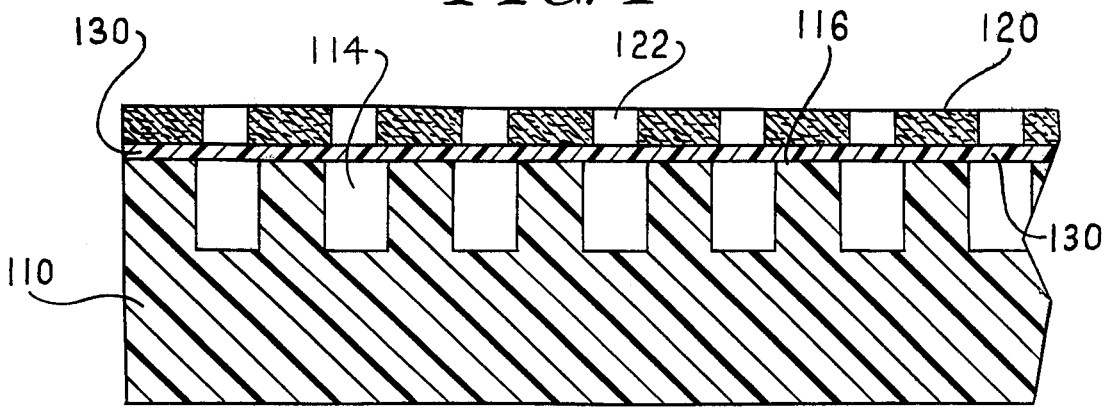
FIG. 5 is a section on 5—5 of FIG. 4.

With particular attention paid to FIGS. 4 and 5, an alternate embodiment of this invention resulting in a most unusual and useful alternate embodiment of this invention is understood.

In this case, the board 110 is essentially identical to the board 10 shown in the previous FIGURES. Likewise, the grooves 114 and ribs 116 are essentially the same as previously described grooves and ribs 14 and 16. Also, the fiberglass cloth covering 120 in this new embodiment is the equivalent of the covering 20 in the previously described FIGURES and the perforations 22 in the previously described FIGURES are essentially duplicated by the perforations 122 in this alternate embodiment of FIGS. 4 AND 5.

The unusual feature, here (FIGS. 4 and 5) is the thin, impervious film 130. This film can be of any suitable plastic material or the like, an excellent example of which is Mylar. This film will be very thin, being only in the neighborhood of 1–10 mils, normally, although the exact thickness is not the critical point.

The film, being located as it is, displays a very unusual tendency. The sound waves are still trapped in the holes 122, and passed directly through the film 130 into the grooves 114 where they are dissipated into the board as previously described.

The very unusual quality now imparted to this acoustical board utilizing the film 130 as shown is that oil existing in the atmosphere, (such as an engine rooms) is prevented from penetrating into the board 110. This feature is of extreme importance in shipboard locations, particularly, since fire hazards must be eliminated as nearly as possible, and acoustical board is generally known to absorb and retain oil. Even though the board itself may not be of a combustible material, oil or the like, impregnated in such a board will of course give rise to a severe combustion hazard.

Completely sealing a normal acoustical board results in destruction of its acoustical qualities. With the unusual structure developed in this particular board, however, the perforations 122 in the fiberglass or the like covering, 120 will still entrap sound sufficiently, and pass it through the individual portions of the membrane 130 into the board grooves 114, where it is dissipated. At the same time, the oil in the atmosphere is prevented from entering into the basic board, and of course, such oil and the like may be removed easily from the relatively thin fiberglass cloth coating and presents virtually no hazard there.

The exact definition of a total limit to the different materials which may be used for the film 130 becomes difficult. It is known that Mylar does this job excellently in very thin film form. Also, such materials as polyethylene and the like, may be used, but have the disadvantage that they may not be in themselves incombustible. This creates a minor and undesireable hazard.

Basically, the test for each film which might be used becomes an empirical test to determine if the acoustic qualities are retained. The nature of the film must be such that the sound waves are gathered by the perforations in the fiberglass cloth and are transmitted through the film into the grooves in the board. In other words, the film must have the ability to carry sound waves through passages on both sides of the film.

While the embodiments of this invention, shown and described is fully capable of achieving the objects and advantages desired, it will be clear to those skilled in the art, that modifications can be made without departing from the inventive concepts disclosed. The embodiments shown, are strictly for purposes of illustration.

I claim:

1. An acoustical facing material comprising a melamine board, including a plurality of longitudinal ribs on one side thereof, having grooves between each pair of ribs; an impervious thin film covering the ribbed side of said board; and a fabric covering material covering said impervious film, said fabric material being perforated with perforations intermediate said ribs.

2. The acoustical facing material of claim 1 wherein the melamine board is of a thickness not less than 1 nor more than 2 inches, and wherein the longitudinal ribs are 3/16 inch in width and are separated from one another by spaces not less than 3/16 inch nor more than ⅜ inch in depth, said ribs being spaced upon ½ inch centers from one to another; and wherein the impervious thin film is impervious to the passage of oil and is of such nature that sound waves may be transmitted through it into the grooves between the ribs; and wherein the fabric covering material covering said impervious film is of glass fiber cloth provided with rows of holes above the centers of the spaces between said ribs.

* * * * *